United States Patent [19]

Marforio

[11] 4,019,448

[45] Apr. 26, 1977

[54] WORKPIECE GUIDE FOR SEWING MACHINES

[75] Inventor: Nerino Marforio, Milan, Italy

[73] Assignee: Rockwell-Rimoldi S.p.A., Milan, Italy

[22] Filed: Oct. 9, 1975

[21] Appl. No.: 621,224

[30] Foreign Application Priority Data

Mar. 12, 1975 Italy ..... 21156/75

[52] U.S. Cl. ..... 112/153

[51] Int. Cl.[2] ..... D05B 35/10

[58] Field of Search ..... 112/153, 136, 152, 121.15

[56] References Cited

UNITED STATES PATENTS

| | | | |
|---|---|---|---|
| 2,064,733 | 12/1936 | Conaway | 112/153 |
| 3,511,494 | 5/1970 | Szentkuti | 112/153 X |
| 3,782,310 | 1/1974 | Stockel | 112/153 |
| 3,913,507 | 10/1975 | Pollmeier | 112/153 |

FOREIGN PATENTS OR APPLICATIONS

| | | | |
|---|---|---|---|
| 644,844 | 9/1962 | Italy | 112/153 |

*Primary Examiner*—Werner H. Schroeder
*Assistant Examiner*—Peter Nerbun

[57] ABSTRACT

An improved workpiece guide for sewing machines comprising a vertical wall which is substantially at a right angle to the support surface of the work, wherein is positioned in the right-hand side of the sewing station, one or more separating plates movable between operative and inoperative positions, which plates project beyond the vertical wall parallel to the work support surface and are positioned to project over the sewing axis both on the right-hand side and the left-hand side thereof when in the operative position, and means to elevate the separating plates when in the inoperative position to locations vertically above the positions they occupy when in the operative position.

3 Claims, 3 Drawing Figures

Fig. 1
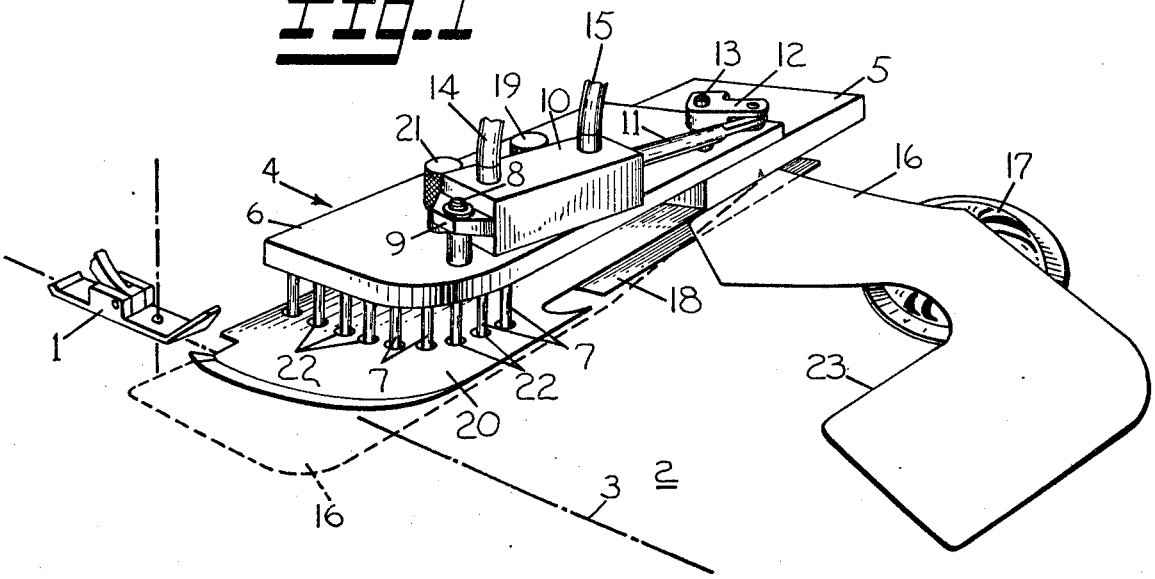
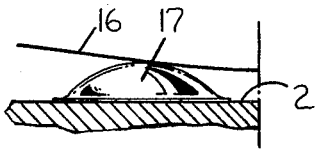
Fig. 3
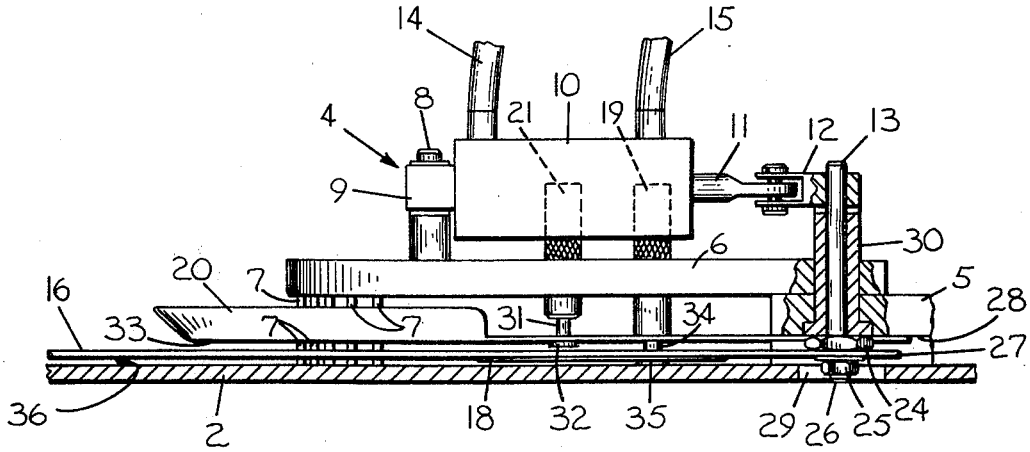
Fig. 2

WORKPIECE GUIDE FOR SEWING MACHINES

BACKGROUND OF THE INVENTION

The number of plates in sewing machine fabric guides depend on the number of layers comprising the article being sewn and, more particularly, the number of plates must be such as to produce a number of parallel, superposed guide channels equal to the number of layers so that the layers can slide separately in these channels. It is essential to separate the layers to enable them to slide relative to one another and to automatically match the edges of the layers of the article being sewn. The plates which project beyond the vertical fabric guide wall may be stationary or movable in a vertical direction to vary the depth of the guide channels for the purpose of varying the thickness of the fabric. In the latter case, the vertical wall consists essentially of a series of vertical pins distributed along a path of travel forming an acute angle with the sewing axis.

According to known embodiments, the guide separating plates can also be moved sideways or can rotate to enable them to be moved away from the sewing zone to permit the passage of thicker sections of fabric such as pockets, loops, belts or other items which have been previously attached to the article.

The displacement of the plates can be controlled by suitable means such as pneumatic means actuatable by means of a push button, toggle switch or other suitable control means and it can also take place when the sewing machine is being operated.

It has been found that guides comprising plates capable of translational or rotational movements are subject to the disadvantage that during the step of reinserting them between the layers of fabric, particularly if this fabric consists of extremely flexible material, the movable plates bump against the edges of the layers, rolling them up without being inserted therebetween.

DESCRIPTION OF THE INVENTION

The principal object of the present invention is to ensure that the movable plates do not bump against the edges of the layers during the step of reinserting them between the layers, that is, when they return to their operative position.

Other objects, features and advantages of the present invention will be made apparent in the course of the following detailed description of a preferred embodiment thereof which is provided by way of a non-limitative example only with reference to the accompanying drawings, in which:

FIG. 1 is a perspective view of the guide with the intermediate plate rotated into the inoperative position;

FIG. 2 is a front view of the guide with the intermediate plate in the operative position; and FIG. 3 represents a feature of the guide according to the invention;

This object of this invention is fully attained by means of a guide according to the present invention which consists of a guide of the aforementioned type comprising, inter alia, means which are adapted to cause the plates which are moved from the operative position to the inoperative position to adopt a position with respect to the work surface which is above the height of the guide channels defined by the plates such that during their movement from the inoperative to the operative position the plates effect a downward movement.

For a clearer understanding of this invention reference is now made to FIG. 1 which shows a presser foot 1 of a normal sewing machine (not shown) comprising, inter alia, a work surface 2 and advancement means (not shown) adapted to draw the article being sewn along the sewing axis 3.

A guide 4 is disposed on the right of the sewing axis 3, as viewed in FIG. 1. It consists of a plate 5 attached to the work surface 2 or to a base plate disposed on the work surface. The plate 5 supports a second plate 6 which extends towards the sewing axis 3 and has mounted therein, at one end, a plurality of pins 7 which are disposed in such a way as to substantially form a vertical wall at a right angle to the work surface 2 and disposed on the right-hand side of the sewing axis 3. A pivot pin 8 is also attached to the plate 6. Pivotably attached to this pin 8 is a boss 9 of a pneumatic cylinder 10, the piston rod 11 of which is hinged on the free end of an arm 12 secured at the other end to a pin 13. The pneumatic cylinder comprises supply conduits 14 and 15. Rigidly connected to the pin 13 is a plate 16 which is movable between the operative position indicated by the dotted line in the figure and an inoperative position in which it is disposed on top of the means 17 designed to raise the movable plate with respect to the position which it normally takes up when it is in the operative position. It should be noted that plate 16 covers or crosses the sewing axis when it is in its operative position separating layers of fabric and that it does not cross the sewing axis when it is in its inoperative position. A plurality of plates similar to plate 16 can be used, if desired, to form a plurality of fabric guide channels and the vertical position of these plates can be achieved by means of the adjusting mechanisms described below. It should be noted that plate 16 covers or crosses the sewing axis when it is in its operative position separting layers of fabric and that it does not cross the sewing axis when it is in its inoperative position.

The means 17 consists essentially of a projection in the form of a hemispherical cap secured to the work surface 2 or obtained by padding in the surface itself. In the course of its movement the movable plate 16 slides over a support plate 18 which is vertically adjustable by means of a suitable adjustment knob 19. The movable plate 16 occupies an intermediate position with respect to the guide 4 between the work surface 2 and an upper plate 20 which vertically limits the guide in its upward movement.

The upper plate 20 is vertically adjustable by means of an adjustment knob 21 to the adjustment knob 19.

The upper plate 20 is rendered vertically adjustable by virtue of the fact that it comprises a series of holes 22 within which the above-mentioned pins 7 are freely movable.

Displacement of the movable plate 16 between upper plate 20 and work surface 2 is made possible by the fact that it comprises a recess 23 which is shaped in such a way that the profile of recess 23 is identical to that of the line along which the pins 7 are disposed and against which the recess 23 of the plate 16 comes to rest.

Referring now to FIG. 2, the pin 13 is rigidly connected to the movable plate 16 by means of a nut 24 and a check or lock nut 25 screwed onto the threaded end 26 of the pin. The nuts 24 and 25 grip the part of the plate which is disposed in a space 28 in the plate 5.

The work surface includes a cavity 29 within which the above-described securing means are located. The pin 13 is mounted in a seating consisting of a bushing 30 which is secured to the two plates 5 and 6, as by an interference fit or the like.

The knob 21 is connected to the upper plate by means of a tang 31 which fits in a corresponding hole (not shown) provided in the plate 20 and which is held in position by a protruding part 32 that prevents it from slipping out of the hole.

When the adjustment knob 21 is screwed into the plate 6, the protruding part 32 is raised and, as a result, the plate 20 is thereby raised, thus varying the depth of a fabric guide channel 33 formed between the plate 16 and upper plate 20.

Similarly, the movable plate 16 is engaged by its own adjustment knob 19 by means of a tang 34 which passes through the upper plate 20 and through the support plate 18 without touching them.

The tang 34 comprises a protruding portion 35 which is designed to be inserted on the underside of the support plate 18 in order to raise the movable plate 16 when the adjustment knob 19 is rotated to vary the depth of the fabric guide channel formed between the plate 16 and the work surface 2.

The method of operation of the guide will now be described:

Before commencing to sew the layers forming the workpiece, the presser foot 1 is raised from the work surface and the plate 16 is disposed on top of the projection 17 which keeps it in a raised position. The height of the projection 17 is actually greater than the maximum height which the movable plate can attain through rotation of its adjustment knob 19.

The operator then inserts the layers of the workpiece beneath the presser foot, taking care to match the layers perfectly, and then lowers the presser foot by using suitable control means (not shown). The lower layer of the workpiece rests on the work surface 2 while the upper layer thereof is physically held with the edge turned up until the pneumatic cylinder 10 is supplied with power by the actuation of suitable control means (not shown). This causes the movable plate 16 to rotate by means of the piston rod 11 which is connected to the pin 13, which is, in turn, rigidly connected to the movable plate 16. The movable plate 16 thereupon moves away from the projection 17 and descends onto the lower layer of fabric workpiece. The projection 17 is located in such a position that the plate 16 begins to lower when it is already interleaved between the upper and lower layers of the workpiece, thereby eliminating the risk of bumping against the edge of a layer and displacing it from its proper flat position.

When the movable plate has ceased to rotate and is disposed in the operating position represented by the dotted lines in FIG. 1, the upper layer of the workpiece is located between the movable plate 16 and the upper plate 20. At this point, the operator can begin sewing. If in the course of sewing the operator comes up against pockets or other items which have previously been attached to the workpiece and which are much thicker than the guide channels can accommodate, to permit these objects to pass through the guide and prevent them from becoming stuck between the plates, he must move the plate 16 from the operative position to the inoperative position by actuating suitable control means (not shown) to reverse the movement of piston rod 11. In this way, the layers of the workpiece cease to be separated in the area adjacent the sewing station. When the operator has finished sewing in the region of the pockets or other items, he reinserts the movable plate 16 between the two layers of workpieces. This operation, which always takes place with the machine in motion, is facilatated by the fact that the movable plate effects both a rotational movement and a lowering movement.

The means 17 which is designed to raise the movable plate may possess a different configuration from the one illustrated and its position with respect to the sewing axis may vary according to the zone within which the movable plate is to be inserted between the layers of workpieces. As a consequence, the stroke of the cylinder 10 will also be regulated in such a way that the extent to which the movable plates are rotated will vary between a maximum of about 90° and a minimum which is such as to bring the plates into a preselected inoperative position. An inoperative position in which the movable plates cross the sewing axis is advantageous in situations where it is wished to keep the layers separate both during the passage of increased thicknesses of fabric and to facilitate the repositioning of the movable plates into the operative position with the sewing machine in motion.

Although the present invention has been described in connection with preferred embodiments, it is to be understood that modifications and variations may be resorted to without departing from the spirit and scope of the invention as those skilled in the art will steadily understand. Such modifications and variations are considered to be within the purview and scope of the invention and the appended claims.

What is claimed is:

1. In a workpiece guide for sewing machines having a vertical wall disposed perpendicular to the work surface of the machine on the right hand side of the sewing axis with an upper plate spaced from the work surface and extending parallel with the latter beyond the sewing axis, the improvement comprising:

a. at least one movable plate (16) pivotably mounted intermediate the upper plate and the work surface;

b. means for pivoting said movable plate between an operative position overlying the sewing axis and an inoperative position spaced from the sewing axis; and c. means on the work surface for operative association with said movable plate for elevating the latter in its inoperative position to a location above its operative position for effecting a descending movement thereof during its return to the latter position by said pivoting means.

2. The workpiece guide according to claim 1 wherein said pivoting means includes a pneumatic cylinder (10) operatively connected to said moveable plate (16).

3. The workpiece guide according to claim 1 wherein said elevating means defines a hemispherical cap (17).

* * * * *